US005982902A

United States Patent [19]

Terano

[11] Patent Number: 5,982,902

[45] **Date of Patent: *Nov. 9, 1999**

[54] SYSTEM FOR GENERATING ATMOSPHERIC QUASI-SOUND FOR AUDIO PERFORMANCE

[75] Inventor: Kaori Terano, Tokyo, Japan

[73] Assignee: NEC Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/447,046

[22] Filed: May 22, 1995

[30] Foreign Application Priority Data

May 31, 1994 [JP] Japan ..... 6-117772

[51] Int. Cl.[6] ..... H04R 5/00

[52] U.S. Cl. ..... 381/17; 381/61; 381/119

[58] Field of Search ..... 381/17, 18, 61–63, 381/109, 103, 98, 24, 300, 119–120

[56] References Cited

U.S. PATENT DOCUMENTS

| | | | |
|---|---|---|---|
| 4,628,789 | 12/1986 | Fujimori | 381/61 |
| 5,027,687 | 7/1991 | Iwamatsu | 381/18 |
| 5,046,097 | 9/1991 | Lowe et al. | 381/17 |
| 5,173,944 | 12/1992 | Begault | 381/24 |
| 5,394,472 | 2/1995 | Broadie | 381/1 |

*Primary Examiner*—Paul Loomis
*Assistant Examiner*—Duc Nguyen
*Attorney, Agent, or Firm*—Sughrue, Mion, Zinn, Macpeak & Seas, PLLC

[57] ABSTRACT

An atmospheric quasi-sound generating system for music performance includes a reproducing device for reproducing the sound of a piece of music from a recording medium to obtain a musical sound signal, an effective sound library for storing effective sounds to generate any atmospheric sound for music performance, a selection device for select a desired effective sound from the effective sound library to output information on the selected effective sound, a position determining device for determining the acoustic image position of the selected effective sound on the basis of the information on the effective sound to generate acoustic image position information, a stereophonic sound generating unit for disposing the effective sound to the determined acoustic image position to thereby output a stereophonic sound signal containing these sound information, and a mixing device for mixing the stereophonic sound signal and the musical sound signal reproduced from the reproducing device. The mixing signal thus obtained is output from speakers.

22 Claims, 4 Drawing Sheets

FIG. 2

| | SOUND EFFECT NAME | SHIFT OR NON-SHIFT | POSITION (UP / DOWN) |
|---|---|---|---|
| 1 | THE SOUND OF BIRDS | 1 | 1 |
| 2 | THE MURMUR OF BROOKS | — | 0 |
| 3 | HUMAN VOICE | 1 | — |
| 4 | THE SOUND OF FOOTSTEPS | 1 | 0 |
| 5 | THE SOUND OF HAND CLAPPING | — | — |
| 6 | THE SOUND OF WAVES | — | — |
| 7 | THE SOUND OF LEAVES | — | — |
| 8 | THE SOUND OF THE HUSTLE AND BUSTLE | — | — |
| 9 | THE MURMUR OF HUMAN VOICE IN CONCERT HALL | — | — |
| 10 | THE MURMUR OF HUMAN VOICES IN LIVE HOUSE | — | — |

SYSTEM FOR GENERATING ATMOSPHERIC QUASI-SOUND FOR AUDIO PERFORMANCE

BACKGROUND OF THE INVENTION

1. Field of the Invention

The present invention relates to an apparatus and a method for generating an atmospheric quasi-sound for music performance, and particularly to an atmospheric quasi-sound generating system for music performance included playback in which an atmospheric sound for music performance is artificially generated, and quasi-sound thus generated is added to reproduced sound of pieces of music.

2. Description of Related Art

Most of audio devices have been hitherto designed to reproduce only the sound of pieces of music (hereinafter referred to as "musical sound") which have been already recorded, and in order to break such a circumstance, some special audio devices have been developed to have a function of making sound effects such as the song of a bird, the murmur of a brook or the like to generate a favorite atmospheric sound and superposing the sound on the reproduced sound of a piece of music.

One of such audio devices is disclosed in Japanese Laid-open Patent Application No. Hei-4-278799. The audio device as disclosed in the above publication as shown FIG. 3 has been implemented to obtain the more satisfactory presence by outputting not only a sound field by a musical performance sound, but also an atmospheric sound simulating a musical performance sound in a concert hall, and it is equipped with a sound field controller for generating an initial reflection sound signal 15 and a reverberation sound signal 16 by an acoustic signal and outputting them from the corresponding loudspeaker system 14. This controller is provided with an atmospheric sound source 11 for storing atmospheric sound signals corresponding to a direct sound 31, an initial reflection sound 32 and an atmospheric signal 33 simulating a reverberation in a concert hall, by a format corresponding to the direct sound 31, the initial reflection sound 32 and the reverberation sound 33 or a format corresponding to the loudspeaker system 14, and a mixing means for mixing the direct sound signal, the initial reflection sound signal and the reverberation sound signal and the atmospheric sound signal. With this construction, not only a sound field by a musical performance sound, but also an atmospheric sound in a concert hall can be produced, so that a sound field with concert-hall presence can be reproduced.

In the conventional audio devices as described above, however, the atmospheric sounds which are reproduced in addition to the sound of pieces of music are those sounds which have been already recorded, and thus the devices have the following problem occurs. That is, if these atmospheric sounds are recorded in a studio, the presence of these sounds is insufficient when reproduced. Furthermore, if these sounds are recorded under actual conditions, reproduction of these sounds is restricted under specific atmospheres for music performance.

The audio device as disclosed in Japanese Laid-open Patent Application No. 4-278799 enables an user to feel as if he was in a concert hall, however, it has the following problem. That is, the atmospheric sound signals contain no information on the position of a sound field, and thus there is a possibility that the atmospheric sound source is overlapped with the sound of a piece of music in acoustic image position. In this case, the atmospheric sound disturbs user's listening to the piece of music, and thus the user cannot listen to the piece of music comfortably. Likewise, in the audio device which generates sound effects such as a bird's song, the murmur of a brook or the like and superimposes the sound effects on the sound of a piece of music (musical sound) as described above, the sound effect is overlapped with the musical sound, and the user's listening to the musical sound is also disturbed.

SUMMARY OF THE INVENTION

An object of the present-invention is to provide an apparatus and a method in which an outdoor or indoor atmospheric sound for music performance is artificially generated to achieve an atmospheric sound which does not disturbs user's listening to the sound of pieces of music. Therefore this invention provides the apparatus and method by which a user is able to listen comfortably to atmospheric sounds.

In order to attain the above object, according to a first aspect of the present invention, a method of generating an atmospheric guasi-sound for music performance, comprises the steps of reproducing a musical sound signal of a piece of music recorded on a recording medium to obtain a musical sound signal of the piece of music, determining sound effects to be selected from sound effects which are stored in sound effects library to generate any atmospheric sound for music performance, and outputting information on the selected sound effect, determining the acoustic image position of the selected sound effect on the basis of the information on the sound effect to generate acoustic image position information, orientating (fixing) the sound effect output from the sound effects library to the determined acoustic image position on the basis of the sound effect output from the sound effects library and the generated acoustic image position information to thereby output a stereophonic sound signal containing the sound effect and the acoustic image position information thereof, mixing the stereophonic sound signal and the musical sound signal reproduced at the reproducing step to obtain an electrical mixing signal containing the stereophonic signal and the musical sound signal, amplifying the electrical mixing signal, converting the amplified electrical mixing signal to an acoustic signal, and outputting the acoustic signal.

According to a second aspect of the present invention, an apparatus of generating an atmospheric quasi-sound for music performance, comprises a reproducing device for reproducing and outputting a musical sound signal of a piece of music from a recording medium on which pieces of music are pre-recorded, a sound effects library for storing sound effects to generate any atmospheric sound for music performance, a selection device for determining a sound effect to be selected from the sound effects library, and outputting information on the selected sound effect, a position determining device for receiving the information on the sound effect selected by said selection device to determine the acoustic image position of the selected sound effect to generate acoustic image position information, a stereophonic sound generating device for receiving the sound effect which is output from the library in response to the instruction of said selection device and the acoustic image position information generated by the position determining device, and orientating (fixing) the sound effect output from the library to the determined acoustic image position to thereby output a stereophonic sound signal containing the sound effect and the acoustic image position information thereof, a mixing device for receiving the stereophonic sound signal output from the stereophonic sound generating device and the musical sound signal reproduced from the reproducing device to obtain an electrical mixing signal containing the stereophonic signal and the musical sound signal.

According to the apparatus and the method for generating the atmospheric quasi-sound for music performance, the sound effects such as the song of a bird, the murmur of a brook, the voice of a human, the sound of footsteps, the sound of hands clapping, etc. are artificially generated so that these sounds are not overlapped with the sound of pieces of music to which a user listens.

BRIEF DESCRIPTION OF THE DRAWINGS

FIG. 2 is an effective sound table which is provided in a selection device shown in FIG. 1.

DETAILED DESCRIPTION OF THE PREFERRED EMBODIMENT

A preferred embodiment according to the present invention will be described with reference to the accompanying drawings.

Figure 1:
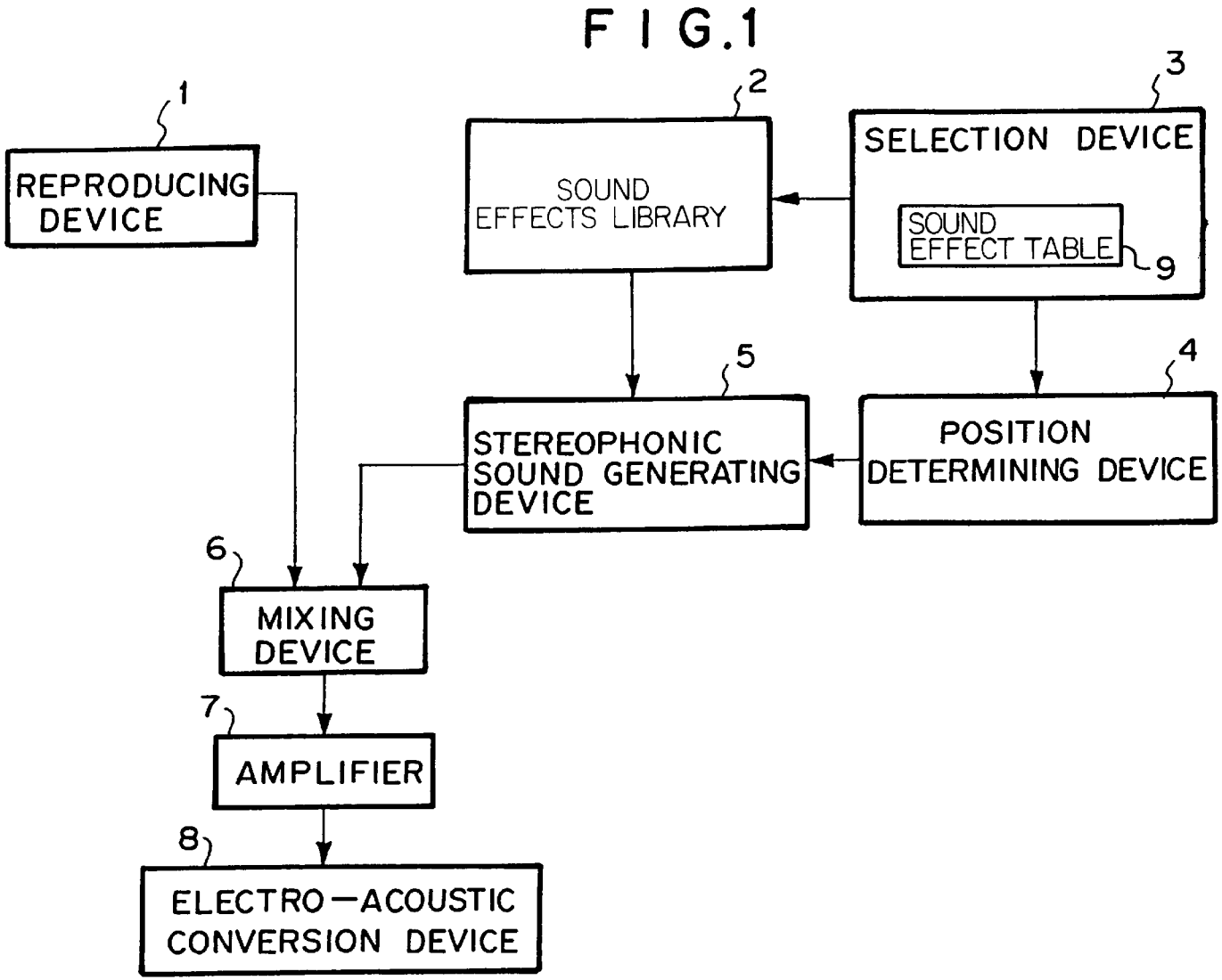
FIG. 1 is a block diagram showing an embodiment of the present invention.
Figure 3:
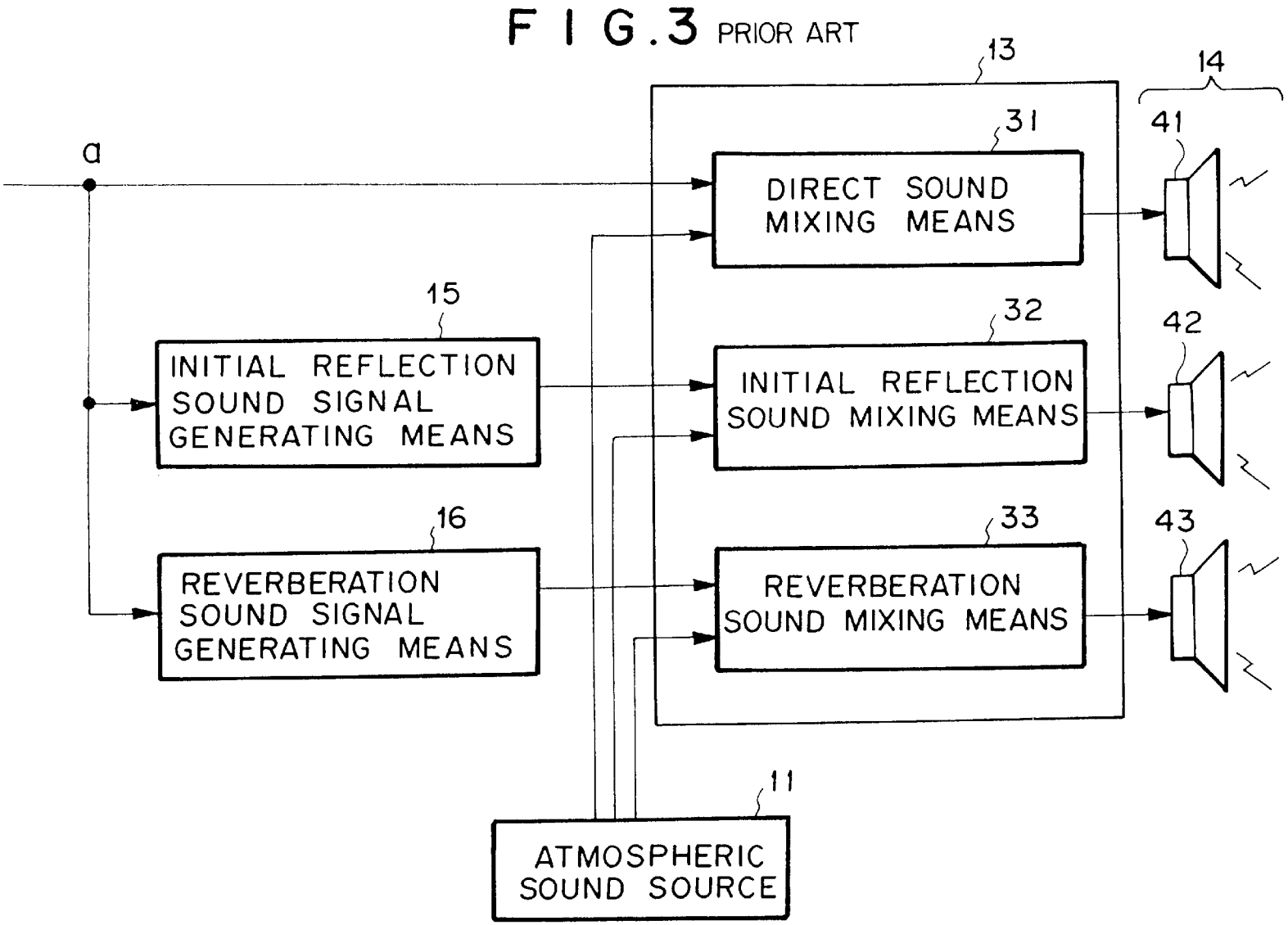
FIG. 3 PRIOR ART
FIG. 3 is a block diagram of a conventional sound field controller for generating a sound field.

FIG. 1 is a block diagram showing an atmospheric sound generating system of an embodiment according to the present invention, and FIG. 2 shows a sound effects table provided in a selection device of the system shown in FIG. 1.

The system for generating an atmospheric quasi-sound for music performance (hereinafter referred to as "atmospheric sound generating system") according to this embodiment includes a reproducing device 1 for reproducing sound (music) information on pieces of music which are recorded on a recording medium, thereby obtaining sound signals of pieces of music, a sound effects library 2 for storing various sound effects, a selection device 3 for determining a sound to be selected from the library 2, a position determining device 4 for determining the acoustic image position of a selected sound effect, a stereophonic sound generating device 5 for orientating (fixing) the selected sound effect to the determined acoustic image position, a mixing device 6 for mixing a generated stereophonic sound and the sound of a piece of music (musical sound) with each other, a amplifier 7 for amplifying a musical sound signal, and an electro-acoustic converting device 8 such as a speaker, head phones or the like.

The reproducing device 1 serves to reproduce pieces of music which are recorded on a compact disc (CD), an audio tape, a digital audio tape (DAT) or the like, and it comprises a CD player, a cassette player or the like.

The sound effects library 2 stores sound effects data for various kinds of sound such as the song of birds, the murmur of brooks, human voices, the sound of footsteps, the sound of hand clapping, etc. Such sound effect data to be recorded in the library 2 may be derived from those data which are recorded on a CD, a cassette tape, a DAT or the like.

The system of this embodiment is designed so that an user can freely store his favorite sound effect data into the [effective sound] library 2, and perform editing such as data addition, data deletion, etc. For the data addition, the user displays on a display device sound effects table containing various sounds which have been stored in the sound effects library 2 to indicate the name of a sound effect to be added, shift or non-shift of the acoustic image of the sound effect, and the position of the acoustic image, and then stores these data into the library 2. For the data deletion, the user refers to the sound effects table to select a sound effect to be deleted, and then deletes the selected sound effects from the library 2.

In addition to the sounds as described above, the sound effect data may contain natural sound data such as the sound of the waves at the seaside, the rustle of leaves, etc., artificial sound data such as the sound of the hustle and bustle, the murmur of human voices in a concert hall, etc. With respect to the sound of the waves, the sounds of plural kinds of waves may be added with different sound names. For example, "the sound of a great wave (billow) at the seaside" and "the sound of a small wave (ripple) at the seaside" may be selectively added with these different sound names. Therefore, the selection of the sounds can be performed more easily.

The selection device 3 has the sound table 9 as shown in FIG. 2, and it serves to manage the sound effects data stored in the library 2. In the sound table 9, "shift or non-shift of acoustic image" 12 and "position (up/down) of acoustic image" 13 are indicated for each sound name 11. The "shift or non-shift of acoustic image" 12 is set so that the shift of an acoustic image is not unnatural. For example, it is natural that the human voices, the song of birds, the sound of footsteps, etc. are set to be shifted, but the murmur of brooks, the sound of hands clapping, the sound of the waves, etc. are set not to be shifted. In the table 9 of this embodiment, the acoustic image is shifted if "1" is set to the "shift or non-shift of acoustic image" 12, and the acoustic image is not shifted in the other cases (i.e., if "1" is not set).

The "position (up/down) of acoustic image" 13 is set when the position of an acoustic image would be unnatural except for a downward position of the acoustic image. For example, for the murmur of a brook, the position of the acoustic image thereof is set to be "down". In the table 9 of this embodiment, if "1" is set to the "position (up/down) of acoustic image" 13, it indicates an upward orientated position (i.e., the acoustic image is positioned to the upper side). On the other hand, if "0" is set to the "position (up/down) of acoustic image" 13, it indicates a downward disposed position (i.e., the acoustic image is positioned to the lower side). In the other cases (i.e., neither "1" nor "0" is set), a special disposed position of the acoustic position is not indicated.

When editing such as addition, deletion or the like is made to the effective sound library 2, the table 9 itself is renewed at the same time.

When a user indicates an atmospheric sound for music performance (such as the sound at the seaside, the sound on a mountain, the sound in a concert hall, the sound in a live house or the like) with a number in the table 9, the selection device 3 refers to the table 9 to select a proper sound effect. The indication of the atmospheric sound may be made by directly specifying a sound target with "bird", "wave" or the like, for example.

The position determining device 4 determines the position of the acoustic image in accordance with the "shift or non-shift of acoustic image" 12 of the table 9. Alternately, the user may directly set the acoustic image position of effective sound effect. The acoustic image position which is to be set by the user is not limited to one point, and the shift of the acoustic image can be controlled on the basis of the shift or nonshift of the acoustic image position, a shift direction from the acoustic image position and a shift amount per hour.

The stereophonic sound generating device 5 serves to dispose a sound effect selected from the library 2 to the coordinate which is set by the position determining device 4. Various stereophonic generating devices are put on the market, and all of these devices may be used. However,in this device 5, these devices must be designed so that the acoustic image of the sound effect can be disposed (positionally fixed) to prevent the sound of a piece of music from being overlapped with the acoustic image of the sound effect. Accordingly, a monaural system having only one speaker is unusable for this purpose, and a listening place such as a speaker studio (system) is preferable and capable of using of 2-channel, 3-channel, 4-channel or multichannel stereo type speakers. In addition, a reproduction system such as a multi-channel sound field reproduction system, a binaural sound field reproduction system, a transaural sound field reproduction system or the like may be used for this purpose. These reproduction systems 51, shown in FIGS. 4A, 4B and 4C, will be described below.

Figure 4A:
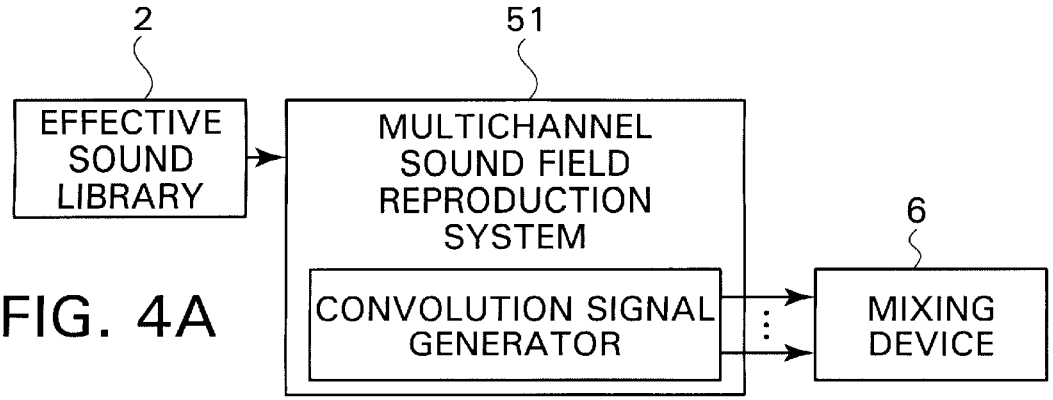
FIGS. 4A–4C are block diagrams of alternative sound generating devices.

The multi-channel sound field reproduction system, shown in FIG. 4A, is a system in which an impulse response in accordance with the direction of reflection sound is calculated and convoluted with a sound source of sound effects to be reproduced, and the convoluted sound is reproduced from speakers. In this case, it is preferable that the sound source of the sound effect was recorded in an anechoic room. In the multi-channel sound field reproduction system, reproduction is generally performed in an anechoic room. However, in a case where reproduction is performed in an echoic room, a user can have a natural orientational feeling by performing an inverted filtering process to cancel the characteristics of the echoic room.

Figure 4B:
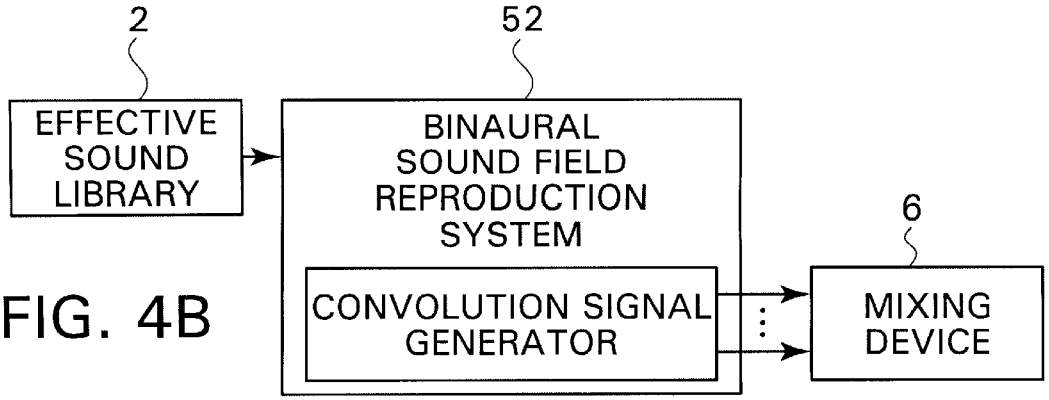

The binaural sound field reproduction system 52, shown in FIG. 4B, is a system in which reproduction signals are generated by performing a convolution between head related transfer functions and the sound source of a sound effect to be reproduced, and the reproduction is directly performed from an earphone or headphone. In this case, the head related transfer functions must be set in consideration of the shape of individual pinnas in advance.

Figure 4C:
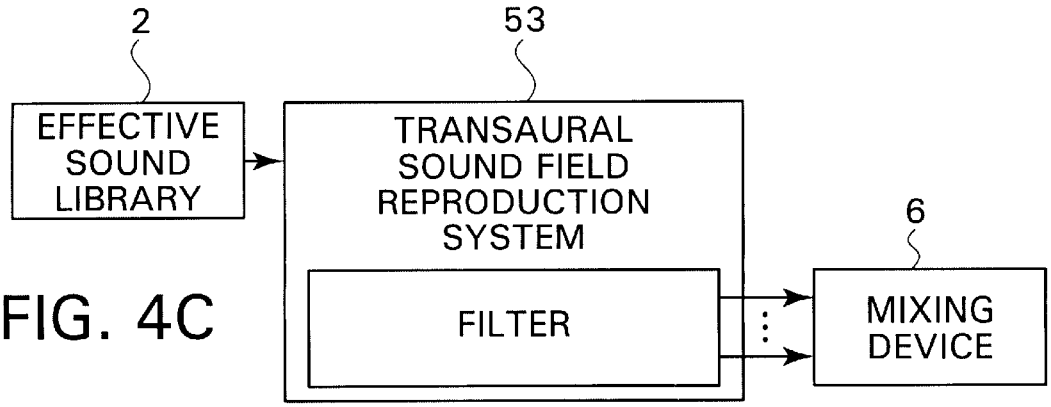

The transaural sound field reproduction system 53, shown in FIG. 4C is a system for reproducing signals obtained by the binaural sound field reproduction system with two speakers. In this case, a filter must be provided for cancelling a signal which is output from a right speaker and enters a left ear and a signal which is output from a left speaker and enters a right ear.

The mixing device 6 serves to mix musical sound data (sound data of a piece of music) transmitted from the reproducing device 1 and sound effect which is made stereophonic by the stereophonic sound generating unit 5, and output the mixed sound to the amplifier 7.

The amplifier 7 amplifies the mixed signal of the musical sound and the sound effects (atmospheric sound), and supplies it to the electro-acoustic conversion unit 8. The electro-acoustic conversion unit 8 converts an electrical signal to an acoustic signal, and it may comprise a speaker, a headphone or the like.

Next, the operation of the system of this embodiment will be described.

First, a user indicates an atmospheric sound for music performance with the selection device 3. The selection device 3 selects a proper sound effect from the library 2 in accordance with the indicated atmospheric sound. When the sound effect is selected, the selection device 3 refers to the table 9 to check the "shift or non-shift of the selected sound effect" 12 and the "position (up/down) of the acoustic image" 13, and outputs it to the position determining device 4 whether the data 12 and 13 should be specified. The selected sound effect data are supplied to the stereophonic sound generating device 5.

The position determining device 4 receives the data on the shift or non-shift of the acoustic image and the position (up/down) of the acoustic image which are output from the selection device, 3, and determines the acoustic image of the sound effect which is selected by the selection device 3. If a specific position is set in the table 9 or there is a user's setting of the position, the determination of the acoustic image position is -performed in accordance with this setting. The user can directly set the acoustic image position of the sound effect, however, the user's setting would be ignored if the specific position of the acoustic image has been set in the table 9. When no position setting is performed, the acoustic image position is determined for the whole sound field.

Subsequently, the stereophonic sound generating device 5 disposes the sound effect to the position determined by the position determining device 4. The sound signals which are generated by the stereophonic sound generating device 5 are transmitted to the mixing device 6. The mixing device 6 mixes the musical sound data transmitted from the reproducing device 1 with the sound effect which is made stereophonic by the stereophonic sound generating device 5, and transmits the mixed sound to the amplifier 7. The amplifier 7 amplifies the mixed signal of the musical sound and the sound effects and supplies it to the electro-acoustic conversion device 8, whereby the sound containing the sound of a piece of music (musical sound) and an atmospheric sound (effective sound) is output from the electro-acoustic conversion device 8 such as a speaker or the like.

For example, when a music performance surrounding is set outdoors and the song of a bird is selected as a desired effective sound, a user can feel as if he heard the sound of a piece of music outdoors with a bird singing above him.

As described above, the atmospheric quasi-sound generating system of the present invention includes the sound effects library for storing sounds to generate any atmospheric sound for music performance, the selection device for determining sound effects to be selected from the sound library and outputting information on the selected sound effect, the position determining device for receiving the information on the sound effect selected by the selection device to determine the acoustic image position of the selected sound effect and generating acoustic image position information, and the stereophonic sound generating device for receiving the sound effect which is output from the library in response to the instruction of the selection device and the acoustic image position information which is determined and generated by the position determining device to dispose the sound effect output from the library to the acoustic image position determined by the position determining device, thereby outputting a stereophonic sound signal, whereby a music performance atmosphere such as outdoor, indoor or the like is artificially generated without disturbing the user's listening to the sound of a piece of music.

What is claimed is:

1. A method of generating an atmospheric quasi-sound for music performance, comprising the sequence of steps of:

determining a sound effect to be selected from sound effects which are stored in a sound effects library to generate atmospheric sound additional to the music, and outputting information on the selected sound effect; and then determining an up/down acoustic image position of the selected sound effect, different from an image position of the pieces of music, on the basis of the information on the sound effect, to generate acoustic image position information; and then disposing the sound effect output from the sound effects library to the up/down acoustic image position different from the image position on the basis of the generated acoustic image position information to thereby output a stereophonic sound signal containing the sound effect and the up/down acoustic image position information thereof; and then reproducing a sound of a piece of music stored on a recording medium, to obtain a musical sound signal of the piece of music; and then mixing the stereophonic sound signal and the musical sound signal reproduced at the reproducing step to obtain an electrical mixing signal containing the stereophonic signal and the musical sound signal; and then amplifying the electrical mixing signal; and then converting the amplified electrical mixing signal to an acoustic signal, and outputting the acoustic signal.

2. The method as claimed in claim 1, wherein the piece of music are reproduced from a CD, an audio tape, a sound portion of a video tape, a sound portion of a laser disc or a digital audio tape.

3. A method of generating an atmospheric quasi-sound for music performance, comprising the sequence of steps of:

selecting a desired sound effect from a sound library in which sound effects are stored to generate atmospheric sound in addition to the musical sound signal, and outputting information of the desired sound effect; and then generating up/down acoustic image position information of the desired sound effect different from image position information of the musical sound on the basis of the information on the selected desired sound effect; and then setting the up/down acoustic image position different from a musical sound position of the desired sound effect on the basis of the up/down acoustic image position information to output a stereophonic sound signal; and then reproducing and outputting a musical sound signal recorded on a recording medium; and then mixing the stereophonic sound signal and the musical sound signal to output a mixing signal.

4. The method as claimed in claim 3, further comprising the steps of:

amplifying the mixing signal; and converting the amplified mixing signal to an acoustic signal, and outputting the acoustic signal.

5. An apparatus, for generating an atmospheric quasi-sound for music performance, comprising:

an input for receiving a musical sound signal of a piece of music;

a reproducing device for reproducing and outputting said musical sound signal;

a sound effects library for storing sound effects to generate an atmospheric sound for music performance;

a selection device for determining a sound effect to be selected from said sound effects library, and outputting information on the selected sound effect;

a position determining device for receiving the information on the sound effect selected by said selection device to determine an acoustic image position of the selected sound effect to generate acoustic image position information, said acoustic image position of the selected sound effect being different from an acoustic image position of said musical sound signal of a piece of music;

a stereophonic sound generating device for receiving the sound effect that is output from the sound effects library in response to said selection device and receiving the acoustic image position information generated by said position determining device, and for disposing the sound effect output from the sound effects library to the determined acoustic image position to thereby output a stereophonic sound signal containing the sound effect and the acoustic image position information thereof; and a mixing device for receiving the stereophonic sound signal from said stereophonic sound generating device and the musical sound signal reproduced from said reproducing device to obtain an electrical mixing signal containing the stereophonic signal and the musical sound signal.

6. An apparatus as claimed in claim 5, further comprising:

an amplifier for amplifying the electrical mixing signal output from said output device; and an electro-acoustic conversion device for converting the amplified electrical mixing signal output from said amplifier to an acoustic signal, and outputting the acoustic signal.

7. An apparatus as claimed in claim 5, wherein said position determining device outputs, on the basis of the sound effect information, at least one of shift information as to whether the acoustic image of the sound effect is shifted or not and up/down position information as to whether the acoustic image of the sound effect is at the upper side or at the lower side.

8. An apparatus as claimed in claim 5, wherein said stereophonic sound generating device is actuated in any one of a multi-channel sound field reproduction system, a binaural sound field reproduction system and a transaural sound field reproduction system.

9. An apparatus as claimed in claim 8, wherein said multi-channel sound field reproduction system is a system in which an impulse response in accordance with the direction of reflection sound of the sound effect is calculated, the calculation result is convoluted with the sound effect and then the convoluted sound signal is output.

10. An apparatus as claimed in claim 8, wherein said binaural sound field reproduction system is a system in which the sound effect is convoluted with a head transfer function, and the convoluted result is output.

11. An apparatus as claimed in claim 8, wherein said transaural sound field reproduction system is a system in which the sound signal corresponding to a convolution result between the sound effect and a head transfer function is filtered to cancel a sound signal which is output from a right side and is directed at a left ear and a sound signal which is output from a left side and is directed at a right ear.

12. An apparatus for generating an atmospheric quasi-sound for music reproduction, comprising:

a sound effects library having stored therein a plurality of sound effects;

a selection device responsive to a sound effect selection to output data corresponding to a selected sound effect from the sound effects library;

a position determining device responsive to the data output from the selection device to output imaging data corresponding to an up/down image positioning of the selected sound effect;

a stereophonic sound generating device receiving the selected sound effect and the imaging data and generating a corresponding stereophonic sound signal;

a mixing device receiving the stereophonic sound signal and a reproduced signal generated by a music reproduction device, and outputting a mixed signal.

13. An apparatus, for generating an atmospheric quasi-sound for music performance, comprising:

a reproducing device for reproducing and outputting a musical sound signal of a piece of music;

a sound effects library for storing sound effects to generate atmospheric sound for music performance;

a selection device for determining sound effect to be selected from said sound effects library, and outputting information on the selected sound effect;

a position determining device for receiving the information on the sound effect selected by said selection device to determine an acoustic image position different from an image position of the sound of a piece of music to generate acoustic image position information for the selected sound effect;

a stereophonic sound generating device for receiving the sound effect which is output from the sound effects library in response to the instruction of said selection device and the acoustic image position information generated by said position determining device, and disposing the sound effect output from the sound effects library to the determined acoustic image position to thereby output a stereophonic sound signal containing the sound effect and the acoustic image position information thereof; and a mixing device for receiving the stereophonic sound signal output from said stereophonic sound generating device and the musical sound signal reproduced from said reproducing device to obtain an electrical mixing signal containing the stereophonic signal and the musical sound signal.

14. A method of generating an atmospheric quasi-sound for music performance, comprising the steps of:

reproducing a musical sound signal of a piece of music;

selecting a sound effect from sound effects that are stored in a sound effects library, separately determining information on the selected sound effect, and outputting said information on the selected sound effect;

determining an acoustic image position of the selected sound effect that is different from an acoustic image position of said music sound signal, on the basis of the information on the sound effect, to generate acoustic image position information;

disposing the sound effect output from the sound effects library to the determined acoustic image position on the basis of the generated acoustic image position information to thereby output a stereophonic sound signal containing the sound effect and the acoustic image position information thereof;

mixing the stereophonic sound signal and the musical sound signal reproduced at the reproducing step to obtain an electrical mixing signal containing the stereophonic signal and the musical sound signal;

amplifying the electrical mixing signal; and converting the amplified electrical mixing signal to an acoustic signal, and outputting the acoustic signal.

15. A method as claimed in claim 14, wherein said musical sound signal is reproduced from at least one of a CD, an audio tape, a sound portion of a video tape, a sound portion of a laser disc, and a digital audio tape.

16. A method of generating an atmospheric quasi-sound for music performance, comprising the steps of:

reproducing and outputting a musical sound signal;

selecting a desired sound effect from a sound library in which sound effects are stored, and outputting information of the selected sound effect;

determining acoustic image information on said selected sound effect and outputting said acoustic image information;

generating acoustic image position information for the selected sound effect different from acoustic image position information of the musical sound signal on the basis of the acoustic image information on the selected sound effect;

setting the acoustic image position of the selected sound effect on the basis of the acoustic image position information to output a stereophonic sound signal; and mixing the stereophonic sound signal and the musical sound signal to output a mixing signal, wherein said mixing signal is an atmospheric quasi-sound for music performance.

17. A method as claimed in claim 16, further comprising the steps of:

amplifying the mixing signal; and converting the amplified mixing signal to an acoustic signal, and outputting the acoustic signal.

18. An apparatus, for generating an atmospheric quasi-sound for an audio performance, comprising:

an input device for receiving an audio sound signal;

a sound effects library for storing sound effects and for outputting sound effects signals;

a selection device for determining a sound effect to be selected from said sound effects library, and outputting first information on the selected sound effect;

a position determining device for receiving said first information on the sound effect selected by said selection device to determine an acoustic image position of the selected sound effect to generate acoustic image position information, said acoustic image position of the selected sound effect being different from an acoustic image position of said audio sound signal;

a stereophonic sound generating device for receiving the sound effect signal that is output from the sound effects library in response to said selection device and for receiving the acoustic image position information generated by said position determining device, and for disposing the sound effect output from the sound effects library to the determined acoustic image position to thereby output a stereophonic sound signal containing the sound effect and the acoustic image position information thereof; and a mixing device for receiving the stereophonic sound signal from said stereophonic sound generating device and said audio sound signal to obtain an electrical mixing signal containing said stereophonic signal and said audio sound signal, wherein said electrical mixing signal comprises synthesized sound effects superimposed on said audio sound signal at an acoustic image position that is different from an acoustic image position of said audio sound signal, to thereby generate an atmospheric sound for audio performance.

19. An apparatus as claimed in claim 18, wherein said selection device includes a sound effect table for storing said first information.

20. An apparatus as claimed in claim 19, wherein said first information comprises at least one of a shifting information and an up/down information for each corresponding sound effect in said sound effect table.

21. A method of generating an atmospheric quasi-sound for audio performance, comprising the steps of:

inputting an audio sound signal;

selecting a sound effect from sound effects that are stored in a sound effects library, separately determining information on the selected sound effect, and outputting said information on the selected sound effect;

determining an acoustic image position of the selected sound effect that is different from an acoustic image position of said audio sound signal, on the basis of the information on the sound effect, to generate acoustic image position information;

disposing the sound effect output from the sound effects library to the determined acoustic image position on the basis of the generated acoustic image position information to thereby output a stereophonic sound signal containing the sound effect and the acoustic image position information thereof;

mixing the stereophonic sound signal and the inputted audio sound signal to obtain an electrical mixing signal containing the stereophonic signal and the audio sound signal;

amplifying the electrical mixing signal; and converting the amplified electrical mixing signal to an acoustic signal, and outputting the acoustic signal.

22. A method of generating an atmospheric quasi-sound for audio performance, comprising the steps of:

inputting an audio sound signal;

selecting a desired sound effect from a sound library in which sound effects are stored, and outputting first information of the selected sound effect;

determining acoustic image information on said selected sound effect on the basis of said first information and outputting said acoustic image information;

generating acoustic image position information for the selected sound effect different from the acoustic image position information of the audio sound signal on the basis of the acoustic image information on the selected sound effect;

setting the acoustic image position of the selected sound effect on the basis of the acoustic image position information to output a stereophonic sound signal; and mixing the stereophonic sound signal and the musical sound signal to output a mixing signal, wherein said mixing signal is an atmospheric quasi-sound for music performance.

* * * * *